US007333932B2

(12) United States Patent
Hain

(10) Patent No.: US 7,333,932 B2
(45) Date of Patent: Feb. 19, 2008

(54) METHOD FOR SPEECH SYNTHESIS

(75) Inventor: Horst-Udo Hain, Munich (DE)

(73) Assignee: Siemens Aktiengesellschaft, Munich (DE)

( * ) Notice: Subject to any disclaimer, the term of this patent is extended or adjusted under 35 U.S.C. 154(b) by 605 days.

(21) Appl. No.: 09/942,736

(22) Filed: Aug. 31, 2001

(65) Prior Publication Data

US 2002/0026313 A1 Feb. 28, 2002

(30) Foreign Application Priority Data

Aug. 31, 2000 (DE) ..... 100 42 942

(51) Int. Cl.
*G10L 13/00* (2006.01)

(52) U.S. Cl. ..... 704/258

(58) Field of Classification Search ..... 704/258, 704/259, 260, 266, 269
See application file for complete search history.

(56) References Cited

U.S. PATENT DOCUMENTS

| | | | | |
|---|---|---|---|---|
| 5,283,833 A | | 2/1994 | Church et al. | |
| 5,651,095 A | * | 7/1997 | Ogden | 704/260 |
| 5,732,388 A | | 3/1998 | Hoege et al. | |
| 5,913,194 A | * | 6/1999 | Karaali et al. | 704/259 |
| 6,029,135 A | | 2/2000 | Krasle | |
| 6,076,060 A | * | 6/2000 | Lin et al. | 704/260 |
| 6,094,633 A | | 7/2000 | Gaved et al. | |
| 6,108,627 A | * | 8/2000 | Sabourin | 704/243 |
| 6,188,984 B1 | * | 2/2001 | Manwaring et al. | 704/260 |
| 6,208,968 B1 | * | 3/2001 | Vitale et al. | 704/260 |
| 7,107,216 B2 | * | 9/2006 | Hain | 704/260 |

FOREIGN PATENT DOCUMENTS

| | | |
|---|---|---|
| DE | 196 36 739 C1 | 7/1997 |
| DE | 197 19 381 C1 | 1/1998 |
| DE | 694 20 955 T2 | 7/2000 |
| WO | WO 94/23423 | 10/1994 |

OTHER PUBLICATIONS

Rüdiger Hoffmann, Signalanalyse Und-Erkennung, Berlin 1998, pp. 381-405.

Hain, "Automation of the Training Procedures for Neural Networks Performing Multi-Lingual Grapheme-to-Phoneme Conversion", Proc. Eurospeech '99, vol. 5, Jun. 9, 1999, pp. 2087-2090.

Bagshaw, "Phonemic Transcription by Analogy in Text-to-Speech Synthesis: Novel Word Pronunciation and Lexicon Compression", Computer Speech and Language, vol. 12, No. 2, Apr. 1, 1998, pp. 119-142.

(Continued)

*Primary Examiner*—Abul K. Azad
(74) *Attorney, Agent, or Firm*—Staas & Halsey LLP

(57) ABSTRACT

A method, an arrangement and a computer program synthesize speech by grapheme/phoneme conversion. In this case, a search is made for subwords of a given word in a database which contains phonetic transcriptions of words. If at least one subword of the given word is found in the database, a phonetic transcription registered in the database is selected for the subword found. In addition to the subword found, the given word has at least one further constituent, which is not registered in the database. This further constituent is phonetically transcribed with the aid of an OOV treatment, and the phonetic transcription of the subword found and the phonetic transcription of the further constituent are combined.

8 Claims, 1 Drawing Sheet

OTHER PUBLICATIONS

Dutoit, "Introduction to Text-to-Speech Synthesis Introduction to Text-to-Speech Synthesis", An Introduction to Text-to-Speech Synthesis, Text, Speech and Technology, Vo. 3, pp. 115-125.

Hain, "Ein Hybrider Ansatz zur Graphem-Phonem-Konvertierung unter Verwendung eines Lexikons und eines neuronalen Netzes", Electronic Sprachsignal Processing, ELFTF Conference, Conference Volume, W.E.B., Universitaetzverlag, Sep. 4-6, 2000, pp. 160-167, XP002223265, Cottbus, Germany, pp. 162-163.

* cited by examiner

METHOD FOR SPEECH SYNTHESIS

The invention relates to a method, an arrangement and a computer program product for speech synthesis by means of grapheme/phoneme conversion.

Speech processing methods are known, for example, from U.S. Pat. No. 6,029,135, U.S. Pat. No. 5,732,388, DE 19636739 C1 and DE 19719381 C1. Text stored in non-spoken form can be output as speech via speech synthesis. As a rule, for this purpose a search is made for the individual words of the text in a database which contains the phonetic transcriptions of numerous words. The phonetic transcriptions of the words found in the database are combined and can be output as speech.

However, since no database is complete, something which is certainly intended as a rule in order to reduce the size of the database, it keeps on happening that a text contains words which are not found in the database. These words are then transcribed phonetically with the aid of an out-of-vocabulary treatment (OOV treatment). In this case, each word is composed respectively from phonemes assigned to the individual letters of the word. Such OOV treatments are, however, relatively compute-intensive, and generally lead to poorer results than the phonetic transcription of entire words on the basis of database entries.

It is also known to assemble the phonetic transcription of a given word from the phonetic transcriptions of its subwords when the given word consists exclusively of these subwords.

Starting from here, it is the object of the invention to improve speech synthesis to the effect that it is possible to a greater extent to have recourse to phonetic transcriptions of words specified in a database, and that OOV treatments need be used only to a lesser extent.

This object is achieved by means of a method, an arrangement and a computer program product having the features of the independent patent claims.

It is possible by means of the method, the arrangement or the computer program product to have recourse to the phonetic transcriptions of the subwords of a given word even when the given word cannot be assembled completely from subwords contained in the database. The essential idea in this case is that use if made for the first time of a hybrid mode of procedure in which both the phonetic transcription of complete subwords, and an OOV treatment are used for the same given word.

In a preferred development, the OOV treatment for phonetic transcription of the further constituent is performed as a function of the phonetic transcription of the subword found. This renders it possible to markedly raise the quality of the speech synthesis for the further constituent by comparison with a corresponding pure OOV treatment of the entire word. The reason for this is firstly that the phonetic transcription of the subword found is very much more reliable than a phonetic transcription of this subword by an OOV treatment would be. Consequently, it is possible to proceed from a reliable phonetic context in the OOV treatment of the further constituent, and this permits the OOV treatment to come to the correct result with a very much higher probability. Secondly, the phonetic transcription of the subword found is very much longer than the phonemes normally used in an OOV treatment. For this reason, the phonetic context is not only more reliable, but also longer, and so OOV treatment for the further constituent can be carried out on the basis of a larger amount of relevant information. However, this advantage need not necessarily be utilized for the claimed preferred development. Under specific conditions, it can also be sensible when for the OOV treatment for phonetic transcription of the further constituent as a function of the phonetic transcription of the subword found account is taken only of the part of the subword which is immediately adjacent to the further constituent.

The method becomes particularly advantageous when it is not interrupted after a first subword has been found, but a search is made for still further subwords in the given word. This way, as large a section as possible of the given word is assembled from subwords for which reliable information is present in the database, and only the remaining, mostly small further constituent of the word need be subjected to an OOV treatment.

If this remaining further constituent is between two subwords found, the OOV treatment is preferably undertaken as a function of both subregions found. Specifically, in this case both the left-hand and the right-hand phonetic context of the further constituent are reliably prescribed, for which reason it is possible to carry out the OOV treatment with excellent results.

The search for subwords in the database can be optimized by means of various measures. Thus, for example, the aim might be to search only for subwords which have a prescribed minimum length. In practice, a length of 5 letters has proved to be the minimum length, it also being possible for minimum lengths of 3, 4 or 6 letters to be sensible in the case of other boundary conditions, for example for a different language.

Furthermore, the search result is improved when the search for a word part of the given word is not immediately interrupted after the first matching subword is found, but a search is further made for other possible subwords. This can be performed, for example, by supplementing the word part with further letters. As a rule, with this mode of procedure the best result is produced when the longest subword is selected from a plurality of subwords found. However, it is also possible to select a shorter subword when, in conjunction with a longer subword found in the database and contained in the given word, this shorter subword constitutes a larger part of the given word than does the longer subword found per se, when the latter cannot be combined with the second subword found.

The OOV treatment for phonetic transcription of the further constituent can be performed by means of a neuron network.

Alternatively or in addition, a rule-based method or a DTW method can be used for the OOV treatment for phonetic transcription of the further constituent. Such a method is described, for example, in Rüdiger Hoffmann "Signalanalyse und-erkennung" ["Signal analysis and recognition"], Springer Verlag, Berlin, 1998.

However, the OOV treatment can also be performed by means of a second database which contains the phonetic transcription of filling particles normally used in the case of composite words. In German, these are particularly dative and genitive endings which are appended in composite words to the word respectively occurring in front.

Further essential features and advantages of the invention follow from the description of an exemplary embodiment, with the aid of the drawing, in which.

Figure 1:
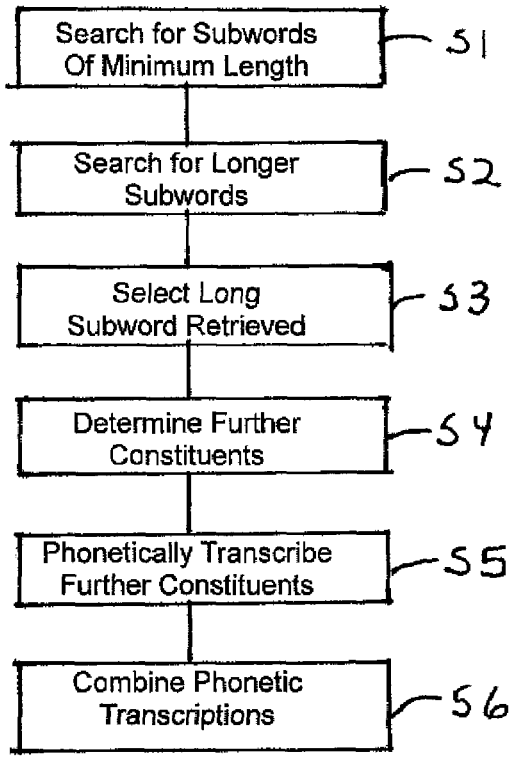
FIG. 1 shows a schematic of the cycle of the method.

The method is to be explained with reference to the example of the given German word "Trainingslager" ["training camp"]. A search is to be made only for subwords with a minimum length of five letters. In step S1 in accordance with FIG. 1, a search is made for subwords of the given word in a database which contains phonetic transcriptions of words. Since the minimum length is set to five letters, a start is made by searching for the word "Train". This word is not found in a German language database. If the database also contains English language words, the first subword of the given word has already now been found. However, a further search is preferably made not only in the first, but also in the second case. This is performed by searching for the word "Traini". This letter combination is not found in the database. The same holds for the letter combination "Trainin" for which a search is made thereafter.

By contrast, the nearest letter combination "Training" is found in the database. Nevertheless, in this case, as well, a further search is preferably made, specifically for the letter combination "Trainings" and the longer letter combinations, formed in the corresponding continuation of this search step, of the given word. Assuming that the given word "Trainingslager" is not found in its entirety in the database, no further subwords are found in the database.

For the case of an English language and German language database, the longer subword "Training" is selected from the two subwords found, namely "Train" and "Training". This selection step does not occur in the example of a purely German language database.

The phonetic transcription registered in the database is selected in step S3 for the subword "Training" found.

It is stipulated in accordance with step S4 that in addition to the subword "Training" found the given word "Trainingslager" has a further constituent "slager" which is not registered in the database.

This further constituent "slager" is then transcribed phonetically in step S5 by means of an OOV treatment. This OOV treatment is preferably based on a conversion of the individual graphemes of the further constituent "slager" into phonemes by means of a neuron network. The phonemes are selected and combined by the neuron network so as to produce the best possible speech synthesis for the further constituent per se.

For an even better speech synthesis result, the OOV treatment for phonetic transcription of the further constituent "slager" is performed as a function of the phonetic description, selected from the database, of the subword "Training" found. In the example selected, the subword "Training" found, or its phonetic transcription reliably prescribes the left-hand phonetic context of the further constituent "slager". The neuron network used for the OOV treatment of the further constituent "slager" can therefore proceed from a reliable result of the syllables of the given word which preceded the further constituent, and can supply a correspondingly reliable result for the phonetic transcription of the further constituent.

Finally, in the last step S6 of the method for speech synthesis the phonetic transcription of the subword "Training" found and the phonetic transcription of the further constituent "slager" are combined.

The speech synthesis result can be further improved when a search is made not only for subwords beginning from the start of the given word, but the search is also started from other areas of the given word. If a specific minimum length i is prescribed for the subword, it is to be recommended to start the further search with the i+first letter. In the given example, the further search is then started for i=5 with the letter sequence "ingsl" which, for its part, is also of the given minimum length. This letter sequence would not be found in the database. The same holds for the letter sequences "ingsla", "ingslag" etc. for which a search is made thereafter.

Since no subword of any sort is found during this further search, the search following thereupon is started not with the letter 2*i+1, but already with i+2. However, the search sequence "ngsla", "ngslag" etc. also leads to no result. After further corresponding searches have been carried out, however, the further subword "lager" is found in the last search. This further subword "lager" found does not originate from the word part of the word "Trainingslager" for which the first subword "Training" was found. Consequently, there is no need in the example to select between the two subwords.

Figure 2:
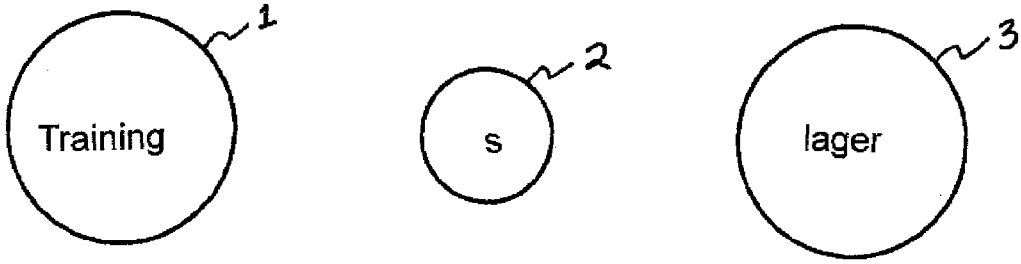
FIG. 2 shows a schematic of a further constituent, occurring between two subwords, of a given word.

Rather, it is now the letter "s" which remains as further constituent of the given word "Trainingslager". This single letter "s" can be phonetically transcribed very easily by means of an OOV treatment. In this case, there is a further alleviating circumstance that in accordance with FIG. 2 both the left-hand context 1 "Training" and the right-hand context 3 "lager" are known for the center 2 "s".

Instead of the OOV treatment by means of a neuron network, as was described above, it is also possible in this case for the OOV treatment to be performed by a search in a further database in which the phonetic transcriptions of filling particles normally used with composite words are contained. The genitive s of the present example is such a filling particle normally used. It would therefore be found in the second database, and the associated phonetic transcription would be selected.

Alternatively, however, it is also possible to use rule-based methods and DTW methods for the OOV treatment. In each case, better phonetic transcriptions of the further constituent are to be expected when the phonetic transcription of a plurality of or all subwords found is taken into account in the OOV treatment for phonetic transcription of the further constituent. Of course, this is the case, in particular, when the further constituent in the word is arranged between two subwords found.

Finally, in a last step the phonetic transcription of the subword "Training" found, the phonetic transcription of the further subword "lager" found and the phonetic transcription of the further constituent "s" are then combined for speech synthesis.

The arrangement according to the invention can be implemented in the form of a computer system which is programmed to execute a corresponding method.

The invention claimed is:

1. A method for speech synthesis by a grapheme/phoneme conversion, comprising:

searching for subwords of a given word in a database which contains phonetic transcriptions of words, the given word having a subword registered in the database, and a further constituent which is not registered in the database;

selecting a phonetic transcription from the database for the subword;

phonetically transcribing the further constituent of the given word with the aid of an out-of-vocabulary (OOV) treatment, the out-of-vocabulary (OOV) treatment of the further constituent being performed based on phonetic context, as a function of the phonetic transcription of the subword; and combining the phonetic transcription of the subword and the phonetic transcription of the further constituent, wherein the out-of-vocabulary (OOV) treatment for phonetic transcription of the further constituent is performed by a neuron network, the given word has at least first and second subwords registered in the database, a search is made for both the first and second subwords in the database, a phonetic transcription is selected from the database for both the first and second subwords, the phonetic transcription of the first and second subwords and the phonetic transcription of the further constituent are combined, the further constituent in the given word is arranged between the first subword and the second subword, and the out-of-vocabulary (OOV) treatment for phonetic transcription of the further constituent is performed as a function of the phonetic transcription of the first subword and the phonetic transcription of the second subword.

2. The method for speech synthesis as claimed in claim 1, wherein the searching for subwords in the database is performed by searching for subwords which have a prescribed minimum length.

3. The method for speech synthesis as claimed in claim 1, wherein if a plurality of subwords are found for the same word part, the longest subword is selected therefrom.

4. The method for speech synthesis as claimed in claim 1, wherein the out-of-vocabulary (OOV) treatment for phonetic transcription of the further constituent is performed by a rule-based method.

5. The method for speech synthesis as claimed in claim 1, wherein the first and second subwords are found in a first database, and the out-of-vocabulary (OOV) treatment for phonetic transcription of the further constituent is performed by a second database which contains the phonetic transcription of filling particles normally used in the case of composite words.

6. A method for speech synthesis by a grapheme/phoneme conversion, comprising:

searching for subwords of a given word in a database which contains phonetic transcriptions of words, the given word having a subword registered in the database, and a further constituent which is not registered in the database;

selecting a phonetic transcription from the database for the subword;

phonetically transcribing the further constituent of the given word with the aid of an out-of-vocabulary (OOV) treatment, the out-of-vocabulary (OOV) treatment of the further constituent being performed based on phonetic context, as a function of the phonetic transcription of the subword; and combining the phonetic transcription of the subword and the phonetic transcription of the further constituent wherein the searching for subwords in the database is performed by searching for subwords which have a prescribed minimum length, if a plurality of subwords are found for the same word part, the longest subword is selected therefrom, the out-of-vocabulary (OOV) treatment for phonetic transcription of the further constituent is performed by a neuron network, the given word has at least first and second subwords registered in the database, a search is made for both the first and second subwords in the database, a phonetic transcription is selected from the database for both the first and second subwords, the phonetic transcription of the first and second subwords and the phonetic transcription of the further constituent are combined, the further constituent in the given word is arranged between the first subword and the second subword, and the out-of-vocabulary (OOV) treatment for phonetic transcription of the further constituent is performed as a function of the phonetic transcription of the first subword and the phonetic transcription of the second subword.

7. The method for speech synthesis as claimed in claim 6, wherein the out-of-vocabulary (OOV) treatment for phonetic transcription of the further constituent is performed by a rule-based method.

8. The method for speech synthesis as claimed in claim 7, wherein the subwords are found in a first database, and the out-of-vocabulary (OOV) treatment for phonetic transcription of the further constituent is performed by a second database which contains the phonetic transcription of filling particles normally used in the case of composite words.

* * * * *